US010835014B2

(12) United States Patent
Baumann

(10) Patent No.: US 10,835,014 B2
(45) Date of Patent: Nov. 17, 2020

(54) LIQUID DISPENSER

(71) Applicant: APTAR RADOLFZELL GMBH, Radolfzell (DE)

(72) Inventor: Tobias Baumann, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 33 days.

(21) Appl. No.: 16/315,489

(22) PCT Filed: Jul. 13, 2017

(86) PCT No.: PCT/EP2017/067773
§ 371 (c)(1),
(2) Date: Jan. 4, 2019

(87) PCT Pub. No.: WO2018/019607
PCT Pub. Date: Feb. 1, 2018

(65) Prior Publication Data

US 2019/0307228 A1 Oct. 10, 2019

(30) Foreign Application Priority Data

Jul. 29, 2016 (EP) ..... 16182018

(51) Int. Cl.
*A45D 34/04* (2006.01)
*B05C 17/005* (2006.01)
(Continued)

(52) U.S. Cl.
CPC ..... *A45D 34/04* (2013.01); *A45D 34/042* (2013.01); *B05B 11/0038* (2018.08);
(Continued)

(58) Field of Classification Search
CPC .... A45D 34/041; A45D 34/042; A45D 34/04; A45D 34/00; B05C 1/06;
(Continued)

(56) References Cited

U.S. PATENT DOCUMENTS 7,163,127 B2 1/2007 Seelhofer
7,314,329 B1 * 1/2008 Byun ..... A45D 19/02 401/279
(Continued)

FOREIGN PATENT DOCUMENTS

DE 10 2011 007 405 A1 10/2012
EP 1 581 436 B1 5/2005
(Continued)

OTHER PUBLICATIONS

International Search Report issued in Application No. PCT/EP2017/067773 dated Oct. 6, 2017 and English translation (7 pages).
(Continued)

*Primary Examiner* — David J Walczak
(74) *Attorney, Agent, or Firm* — Flynn Thiel, P.C.

(57) ABSTRACT

A liquid dispenser for discharging liquids, in particular in rod shape. The liquid dispenser has a liquid store for receiving liquid prior to discharge, and a discharge opening for discharging the liquid. The liquid dispenser has a pumping device having an actuating surface for manual actuation, by which liquid is conveyed from the liquid store to the discharge opening. The liquid store is provided within an exchangeable container unit, couplable to a main unit including the pumping device (62) and the discharge opening, and is uncouplable therefrom. For the exchangeable coupling of the container unit to the main unit is provided a coupling device, by which the container unit, by pressing against the main unit, is alternately couplable thereto and releasable therefrom. The coupling device possesses two coupling members, wherein one coupling member is provided on the container unit and one coupling member on the main unit.

24 Claims, 6 Drawing Sheets

(51) Int. Cl.
*B05B 11/00* (2006.01)
*A46B 11/00* (2006.01)

(52) U.S. Cl.
CPC ..... *B05B 11/0054* (2013.01); *B05B 11/3047* (2013.01); *A46B 11/0065* (2013.01); *A46B 11/0075* (2013.01); *B05C 17/00569* (2013.01); *B05C 17/00586* (2013.01)

(58) Field of Classification Search
CPC . B05C 17/00569; B05C 17/005; B05C 17/00; B05C 17/00586; A46B 11/0065; A46B 11/001; A46B 11/002; A46B 11/0075; B05B 11/0054; B05B 11/0038; B05B 11/0035
See application file for complete search history.

(56) References Cited

U.S. PATENT DOCUMENTS

| | | | | |
|---|---|---|---|---|
| 8,007,480 | B2 | 8/2011 | Kawashiro et al. | |
| 8,177,452 | B2 * | 5/2012 | Tsai ..... | A45D 34/042 401/204 |
| 9,629,438 | B2 | 4/2017 | Bruder | |
| 9,861,177 | B2 | 1/2018 | Lefevre et al. | |
| 10,046,348 | B2 | 8/2018 | Brugger | |
| 2016/0144395 | A1 | 5/2016 | Brugger | |

FOREIGN PATENT DOCUMENTS

| | | | |
|---|---|---|---|
| EP | 2 181 932 | B1 | 5/2010 |
| JP | 2010-012365 | A | 1/2010 |
| JP | 2010-235196 | A | 10/2010 |
| KR | 10-2007-0019939 | A | 2/2007 |
| WO | WO 2012/129318 | A2 | 9/2012 |
| WO | WO 2015/003762 | A1 | 1/2015 |
| WO | WO 2015/070935 | A1 | 5/2015 |
| WO | WO 2015/128572 | A2 | 9/2015 |
| WO | WO 2016/009192 | A1 | 1/2016 |

OTHER PUBLICATIONS

Written Opinion issued in Application No. PCT/EP2017/067773 dated Oct. 6, 2017 (5 pages).
Korean Office Action issued in corresponding Korean Patent Application No. 10-2019-7005740 dated Aug. 21, 2020 (7 pages).

* cited by examiner

LIQUID DISPENSER

FIELD OF APPLICATION AND PRIOR ART

The invention relates to a liquid dispenser for discharging pharmaceutical or cosmetic liquids and to a set comprising such a liquid dispenser.

The invention here relates in particular to liquid dispensers which have a rod shape, comprising a housing which is elongated in the direction of a direction of principal extent and at the end of which is provided the discharge opening, wherein this liquid dispenser can be guided similarly to a pen, between thumb, index finger and middle finger, in order to discharge liquid. Dispensers of the generic type possess a liquid store and a pumping device in order to convey liquid from the liquid store to the discharge opening.

Dispensers of the generic type, and more particularly those in a rod shape, are well suited, in particular, to the discharge of cosmetic liquids, since, by virtue of the pen-like handling, they enable a particularly precise discharge as regards discharge quantity and discharge location.

A typical liquid dispenser in rod shape is known, for instance, from DE 102011007405 A1. The liquid dispenser which is disclosed therein possesses a liquid store, which is an integral component part of the dispenser and, together with this, constitutes a disposable article.

Object and Solution

The object of the invention is to provide a liquid dispenser which allows parts of the dispenser to be reused following emptying of the liquid store.

For this purpose there is proposed a liquid dispenser for discharging pharmaceutical or cosmetic liquids, which is designed as follows: The liquid dispenser has a liquid store for receiving the liquid prior to discharge. It further has a discharge opening for discharging the liquid, and a pumping device having an actuating surface for the manual actuation of the pumping device, by means of which liquid is conveyed from the liquid store to the discharge opening.

The liquid store is provided within an exchangeable container unit, which is couplable to a main unit comprising the pumping device and preferably also the discharge opening, and is uncouplable therefrom. For this purpose, the container unit and the main unit are couplable via a coupling device, by means of which the container unit, by pressing against the main unit, is alternately couplable thereto and releasable therefrom. This coupling device possesses two coupling members, wherein one coupling member is provided on the container unit and one coupling member on the main unit.

In a liquid dispenser according to the invention, said container unit is thus provided as an exchangeable unit. While the main unit, comprising the pumping device and preferably also the discharge opening, is provided, as designated, for a lengthy use, the container unit which comprises the liquid dispenser is intended to be exchanged. This allows, on the one hand, an already completely emptied container unit to be exchanged for a new, full container unit. Furthermore, it is also here possible for the user to use various containers whose content is of the same generic type yet different, for instance various sorts of make-up, on an ad hoc basis in turns.

The subject of the invention is, in particular, how the coupling device for connecting the container unit functions. This coupling device is configured to allow both the coupling and the uncoupling of the container unit, by applying a force to the container unit in the direction of the main unit. Thus, a consistent application of force to the container unit is provided both for the coupling and for the uncoupling. Since the liquid dispenser preferably has a rod shape, the process for the coupling and uncoupling accordingly virtually corresponds to the process with which, in retractable ballpoint pens, the pen tip can be extended and retracted again in turns.

This process is in particular expedient if the main unit possesses a receiving shaft into which the container unit is inserted. Such a receiving shaft stabilizes the connected container unit and, by virtue of its design as part of the main unit, can be designed in higher quality than external walls of the container unit which is exchangeable in the designated manner.

If such a receiving shaft is provided on the main unit, then a coupling device which, for the uncoupling of the container unit, provides an application of force in a separation direction opposite to the slide-in direction, would make it necessary for the container unit to project in relevant measure from the receiving shaft in order to be able to be gripped for the purpose of the exchange.

In the design featuring an application of force to the container unit in the direction of the main unit, which force application is provided both for the coupling and for the uncoupling, the container unit, in the connected state, can by contrast be found in a position set back from the rim of the receiving shaft, and yet can be uncouplable through the opening in the receiving shaft. Preferably, the extent by which the end of the container unit is set back amounts to a few millimeters.

Alternatively to such a type of recessed arrangement of the container unit in the receiving shaft, the container unit can, however, also protrude slightly. This can in particular be expedient in order to be able to detect from outside what type of a container unit is used. For this purpose, various container units have on their segment protruding from the receiving shaft a color coding. However, an end-side labeling of the container is also conceivable, so that it is possible to detect the type of container unit used, where appropriate situated in a set-back position, from this end face, which is still visible in the receiving shaft.

The two coupling members are matched to one another in such a way that, in a state inserted one into the other, they are rotatable relative to one another about a rotational axis. The corresponding rotational axis is preferably defined by the geometry of the coupling members. Alternatively or additionally, an internal wall of the receiving shaft and an external wall of the container unit can be of circular design and provided with virtually identical diameter, so that these walls define the rotational axis.

Preferably, on one of the coupling members is provided at least one retaining cam, and on the other coupling member is provided a corresponding retaining structure having stop faces interrupted in the peripheral direction by gaps, so that the coupling members, in one relative rotation setting, can be released from one another in the direction of the rotational axis when the retaining cam is aligned with a gap. In another relative rotation setting, in which the retaining cam is aligned with a stop face, the coupling members, by contrast, are secured against axial pulling apart.

According to this refinement, it is thus provided that, for the purpose of positive coupling to one of the coupling members, preferably to the coupling member belonging to the main unit, stop faces, which are separated from one another by gaps, are provided. The retaining cam provided on sides of the other coupling member, thus preferably on the container unit, is arranged in a rotation setting in alignment with the gaps, so that they can intrude behind those gaps. In another rotation setting, it is in this case aligned with the stop faces, so that it is thus positively secured against direct withdrawal.

In principle, one retaining cam is sufficient. However, more retaining cams, which are mutually offset in the peripheral direction, in particular two retaining cams on mutually opposite sides, or for each stop face, respectively an assigned retaining cam, can also be provided.

On at least one of the coupling members is preferably provided a gearing-like ramp structure, and on the other coupling device a hereto corresponding mating surface, by which the two coupling devices are rotated relative to one another about the rotational axis into a defined desired relative rotation setting when they are pushed axially toward one another. The number of single ramps of the ramp structure which act in one of the rotational directions here preferably tallies with the sum of the gaps and the gaps provided between them. In particular, it is preferably a case of four or more ramps arranged in the same rotational direction on the gearing-like ramp structure.

Preferably, not only is a ramp structure provided on a coupling member, but also the corresponding mating surface is provided in the form of a ramp structure. These mutually facing structures, which are preferably configured in the manner of a spur gearing, enter into engagement with one another when the container unit, starting from the connected or disconnected state, is pressed as far as possible onto the coupling member of the main unit. These desired relative settings allow the two coupling members to be mutually oriented in a purposeful manner in relation to the peripheral direction in order to, by the pressing together of the coupling members, produce a defined rotation setting in which, depending on the position of the at least one retaining cam upon a subsequent movement apart, either the threading of the retaining cam into a gap or the landing of the retaining cam on a stop face is the consequence. Since preferably in each case one tooth of the gearing-like ramp structure leads to respectively a desired relative rotation setting, a corresponding number of gaps and stop faces is preferably provided.

On the retaining structure, inclined sliding surfaces extended in the peripheral direction are preferably respectively provided between the gaps and the stop faces, wherein, in said desired relative rotation settings, the retaining cam is oriented in such a way relative to the retaining structure that it is aligned with one of the sliding surfaces.

The sliding surfaces ensure that the retaining cam or retaining cams, when moved toward the retaining structure, are shifted out of the transition regions between stop faces and gaps slightly in the peripheral direction, so as either to land on a stop face or be inserted into a gap, so that the main unit and the container unit can be separated from one another.

The designated process in a design comprising one of the aforementioned ramp structures, which generates the desired relative rotation settings, and the described sliding surfaces, is as follows: when the container unit, for coupling purposes, is pressed for the first time onto the main unit, then the retaining cam at the same time crosses one of the gaps provided between the stop faces.

If the hereto necessary relative rotation setting between the main unit and the container unit were to correspond to one of the desired relative rotation settings, then the following pressing of the coupling members would cause no rotation of the container unit and the main unit relative to one another, so that a following force acting in the axial separation direction would result in the container unit being released again from the main unit.

The rotation setting in which the retaining cam can be guided through the gap is therefore one which subsequently, due to the ramp structure and the mating surfaces, causes a slight rotation of the container unit and the main unit relative to one another. This rotation is sufficient to, upon a subsequently occurring opposite relative movement in the axial direction of the container unit relative to the main unit, cause the retaining cam to land on one of the sliding surfaces, wherein this sliding surface is angled such that the retaining cam, after the slight relative rotation movement, lands on a stop face. The connected state is thereby established.

If now the container unit is pressed once again against the main unit, then, due to the interaction of the ramp structure and the mating surface, a relative rotation between container unit and main unit ensues, so that this time the retaining cam is displaced into a relative rotation setting from which it subsequently lands onto a sliding surface which is adjacent to the aforementioned sliding surface and which, due to its inclination, guides the retaining cam into a gap between the stop faces. Both in the coupling and uncoupling of the container unit, it is thus provided that a two-part rotary movement ensues, the first part of which is generated by the pressing of the coupling members one against the other, and the second part of which is generated by the subsequent downsliding of the retaining cam on one of the sliding surfaces.

In addition, a spring device, in particular in the form of a helical spring, can preferably be provided, which spring device, in the coupled state of the coupling device between the coupling members, applies to these a mutually opposing force in a separation direction.

The spring device ensures that a pressing together of the coupling members can only take place upon simultaneous deformation of the spring device, and thus against the force thereof. The result is that, after force has been applied to the coupling members to bring them closer together, the coupling members spontaneously easily separate from one another again in order that, in the course of this movement, the retaining cam can land on the sliding surface.

The spring device can in particular be fixed to one of the coupling members and extend in the direction of the other coupling member. On the other coupling member is preferably provided a guide structure for the spring, which guides the spring during the convergence of the coupling members.

In one particular design, the spring device is configured in one piece with one of the coupling devices. The use of a part of the coupling device which is configured in one piece preferably as a plastics part is advantageous from a production engineering aspect. Although it is in principle preferred that the spring device is provided on the coupling member assigned to the main unit, in such an integrally provided plastics spring it can be advantageous if this is provided on the coupling member of the container unit, since its necessary life is hereby limited, and thus relaxation phenomena in the plastics spring have less relevance. If a metallic spring is used, then this is preferably fixed on sides of the main unit.

The container unit possesses an outlet opening, through which the liquid can flow in the direction of the pumping device. In the delivery state, this outlet opening is preferably closed off by a membrane. For the opening of this closure, on one of the coupling members of the main unit can be provided an opening sleeve, which, upon the coupling of the container unit, punctures the membrane and thereby opens the container unit.

The closure of the container unit with a membrane in the delivery state enables the opening action to be realized solely through the insertion of the container unit, in that the membrane is pressed against the opening sleeve, which latter is preferably provided with a cutting tip. Such a membrane can be an integral part of the container-side coupling member or be welded or adhered to the latter. An alternative design to a membrane provides that a closing ball bears against the opening of the container unit, which closing ball is held in position by slight overpressure in the container unit.

The opening sleeve can also be used to arrange on its outer side the retaining cam or a plurality of retaining cams.

In addition to the secured fastening of the coupling members one to the other, the coupling members preferably also possess a common clamping device, by which the coupling devices, in a relative setting in which they are spaced further apart compared to the positively secured relative setting, are fixable relative to one another.

The clamping device is a non-positively or positively acting clamping device, which, in the designated manner, upon the insertion and/or upon the withdrawal of the container unit from the main unit, in an intermediate setting positionally fix the main unit and the container unit relative to one another, said fixing being easily surmountable. For instance, the punctured membrane, in interaction with the opening sleeve, can form this clamping device. Starting from this position, the container unit can be withdrawn in a non-destructive manner. This fixing position, which is additional to the actual securely coupled position, facilitates the coupling and uncoupling of the container unit, since the container unit, even when it is released in connection with the coupling or uncoupling, does not automatically separate from the main unit and fall to the ground, but initially remains stuck in the region of the clamping device.

The coupling member of the main unit is preferably configured as a plastics part, which combines within it at least two components, selected from the components of the opening sleeve, a fixing region for the spring device and a ramp structure. Preferably, all three components are combined in the one element. Opposite thereto, also the coupling member on the container unit is preferably formed by a one-piece element, in particular made of plastic, which combines within it at least two and preferably three of the components, selected from the components comprising the stop faces, the sliding surfaces and the ramp structure.

As mentioned in the introduction, the housing of the liquid dispenser preferably has a rod shape, wherein the length, without allowing for any cap which may be provided, is preferably in particular at least 100 mm, preferably at least 120 mm, and the maximum diameter is preferably in particular at most 18 mm. The actuating surface of the pumping device can be configured for actuation in particular orthogonally to a direction of principal extent of the liquid dispenser. At least in the region of the actuating surface, the dispenser preferably has a diameter of at most 22 mm.

The described liquid dispenser serves in particular the purpose of discharging cosmetic or pharmaceutical liquids. The liquid store of a liquid store according to the invention is preferably filled with pharmaceutical or cosmetic liquid for topical application, with a cosmetic and/or pharmaceutical skin care product, with a make-up liquid, with lip gloss, with nail varnish, with a mascara or eyeshadow liquid, or with a make-up remover or nail varnish remover.

Depending on the purpose of use, various designs relating to the applicator are conceivable, on which applicator the discharge opening is provided. In order to be able to disperse liquid in a metered manner after this has already previously been discharged, an applicator design comprising a sponge or a textile application surface is suitable. Such an application surface, or perhaps an application surface made of plastic, ceramic or metal and penetrated by the discharge channel, can be slightly inclined in relation to the axis of principal extent of the preferably rod-shaped dispenser, preferably at an angle between 20° and 70°, in order during operation to be oriented, correspondingly with the designated handling of the liquid dispenser in the manner of a pen, in particular somewhat parallel to the skin surface. Other possible applicator designs comprise the arrangement of a rotatable application roller or application ball in the region of the discharge opening, as is known from roll-on deodorants and the like. Depending on the purpose of use, for instance for discharging mascara, a brush on the applicator is also expedient.

In the liquid dispenser according to the invention, it is provided that the container is exchanged in the designated manner by the user. Correspondingly, the invention also relates to a set in which, in addition to the main unit, at least two container units are provided.

BRIEF DESCRIPTION OF THE DRAWINGS

Further advantages and aspects of the invention emerge from the claims and from the following description of a preferred illustrative embodiment of the invention, which is described below with reference to the figures.

DETAILED DESCRIPTION OF THE ILLUSTRATIVE EMBODIMENTS

Figure 1:
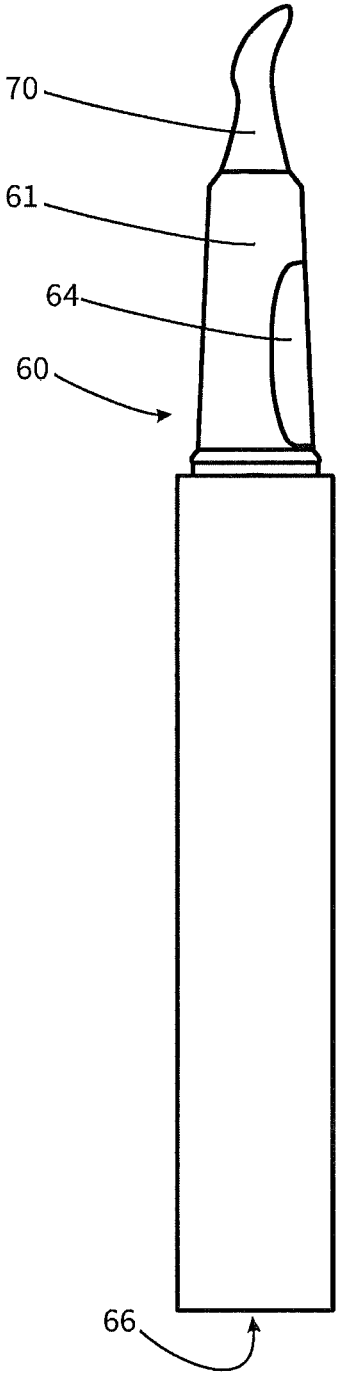
FIGS. 1 and 2 show the dispenser according to the invention in a sectioned and a non-sectioned representation.
Figure 2:
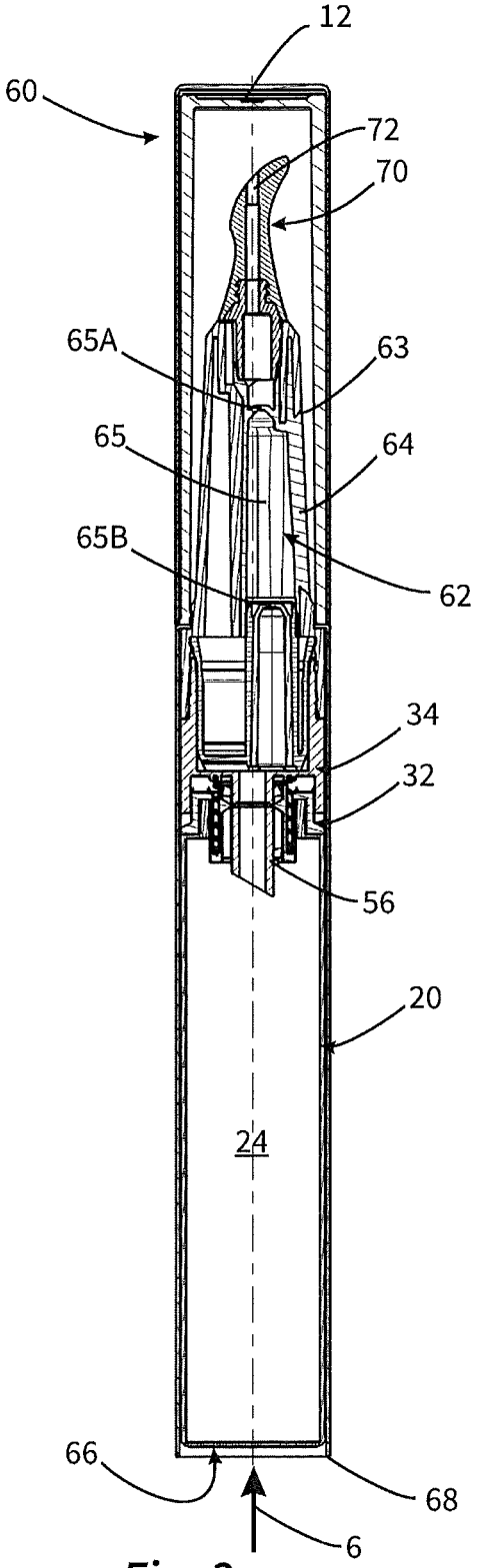

FIGS. 1 and 2 show a liquid dispenser 10 according to the invention in an overall representation.

The liquid dispenser 10 has basically a rod shape and is from the outside, with the exception of the applicator 70 and the actuating handle 64, outwardly basically rotationally symmetric in form. With reference to FIG. 2, in which the liquid dispenser 10 is shown in a sectional representation and with a mounted cap 12, the individual components are described. The liquid dispenser 10 possesses a main unit 60 having a grip 61, on which the actuating handle 64 is provided. This actuating handle 64 is disposed in an aperture 63 in the grip 61 and bounds a pumping chamber 65 of a pumping device 62. By elastic pressing-in of the actuating handle 64, the volume of the pumping chamber 65 can be reduced, so that liquid present therein is forced through a pressure relief valve 65A in the direction of a discharge opening 72 on the applicator 70. If the actuating handle 64 is released again, then a pressure relief valve 65B, which is provided between the pumping chamber 65 and a liquid store 24, opens, so that, under the impact of the expansion of the pumping chamber 65, this is filled up with liquid from the liquid store 24.

The liquid store 24 is part of a container unit 20, which on the end facing away from the discharge opening 72 is inserted in a receiving shaft 66 of the main unit 60. In the connected state of FIG. 2, the container unit 20 is set back from a rim 68 which circumferentially surrounds an opening of the receiving shaft 66. Alternatively, the container unit 20 protrudes from the rim 68 by 5 mm or less, preferably by 2 mm or less, in particular preferably by 1 mm or less. The container unit 20 possesses a coupling member 32, which is described in greater detail further below and which, in the state of FIG. 2, is connected to a coupling member 34 belonging to the main unit.

Figure 3:
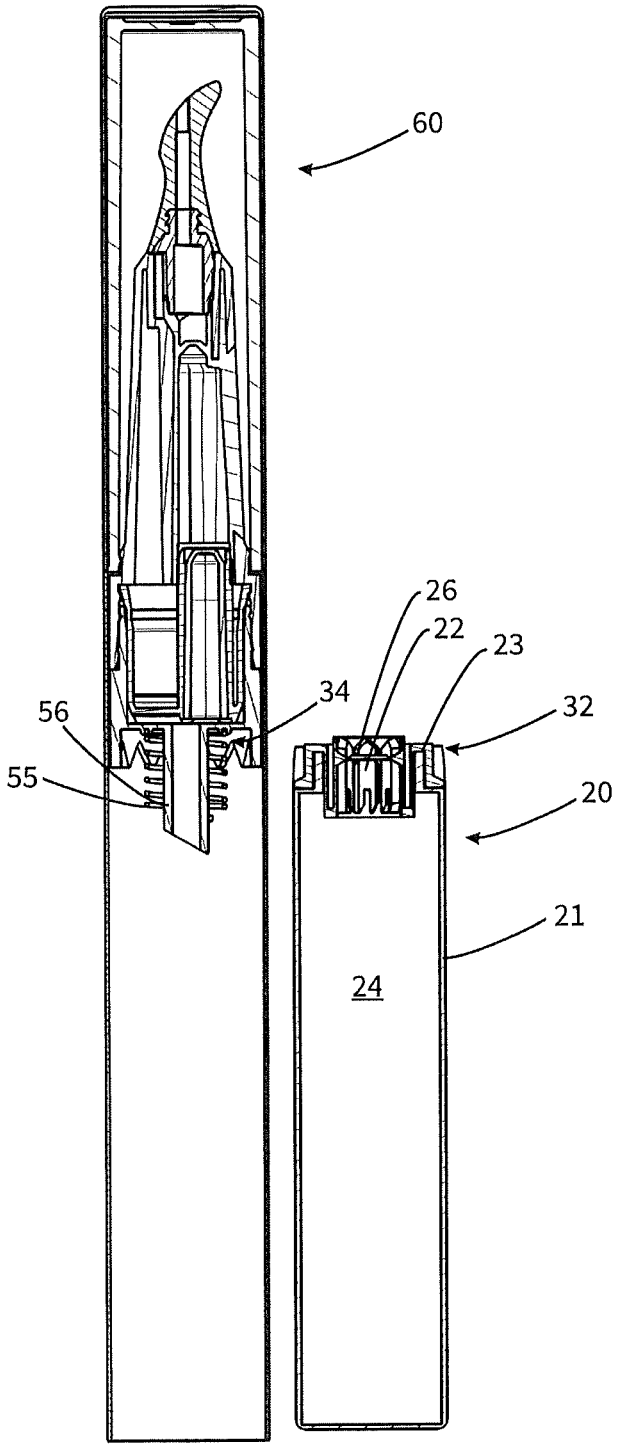
FIG. 3 shows the dispenser of FIG. 1 prior to the insertion of the container unit into the receiving shaft of the main unit.

FIG. 3 shows the main unit 60 and the container unit 20 in separated representation. It can be seen that the container unit 20 consists of two elements, namely an end-closed sleeve element 21, which defines the volume of the liquid store 24, and a thereon mounted element 23, which provides the coupling member 32.

In the state of FIG. 3, in which the container unit 20 has not yet been inserted, an outlet opening 22 of the container unit 20 is still closed off, wherein for this is provided a membrane 26, which forms an integral part with the coupling member 32 on the container unit. Because of the use of just two elements, the container unit 20 can thus be produced very economically.

The essential components of the main unit 60 have already previously been described. Reference is therefore made only to the coupling member 34 belonging to the main unit, which possesses an opening sleeve 56 provided with a cutting tip, which in the designated manner, upon the insertion of the container unit 20, pierces the membrane 26.

The two coupling members 32, 34 are described once again below with reference to FIGS. 4A to 4C and 5A to 5C.

Figure 4A:
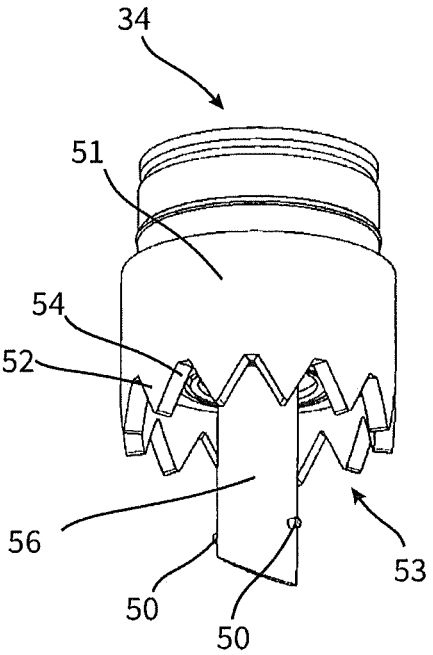
FIGS. 4A to 4C and 5A to 5C show the two coupling members of the coupling device for fastening the container unit to the main unit.
Figure 4B:
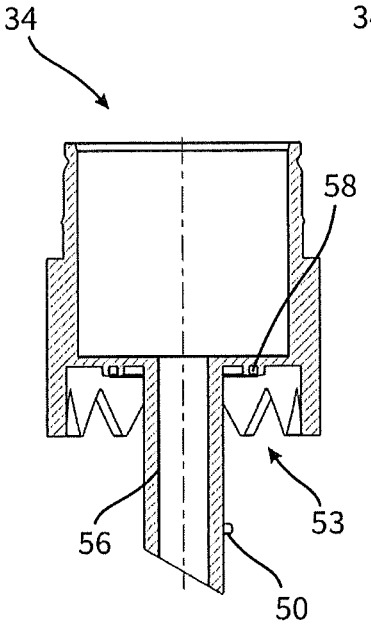
Figure 4C:
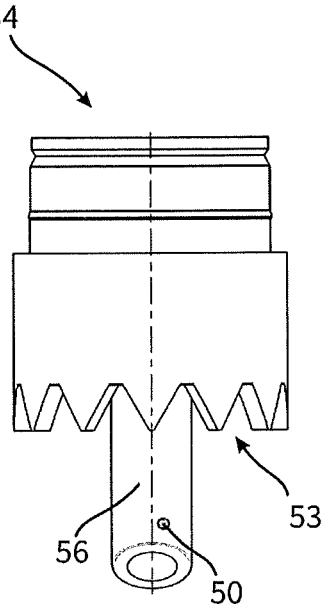

FIG. 4A to 4C show the coupling member 34 belonging to the main unit. This has a comparatively simple structure. An outer sleeve 51 possesses on the end face a gearing-like ramp structure 53 having a total of 12 teeth 52, which are arranged in the manner of a spur gearing and respectively possess two individual ramps 54. In the center of the coupling member 34 is provided said opening sleeve 56, which, in the designated manner, is provided to open said membrane and is configured as a hollow tube, in order to be able to convey liquid from the liquid store 24. In the radial direction, two retaining cams 50 point, on opposite sides, away from the opening sleeve 56. The coupling member 34 additionally possess a fixing region 58 on an element 57 for the fitting of a metallic helical spring 55.

Figure 5A:
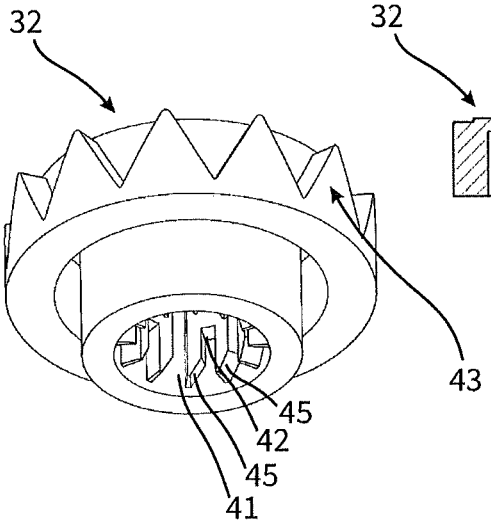
Figure 5B:
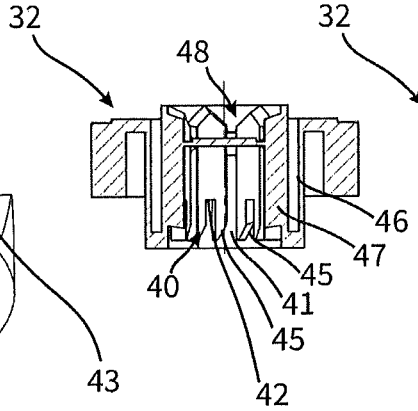
Figure 5C:
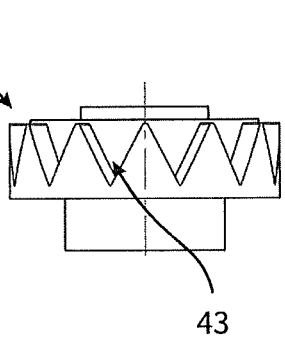

The coupling member 32, represented in FIG. 5A to 5C, on sides of the container unit 20 likewise possesses along its outer periphery a gearing-like ramp structure 43 including ramps 44. Surrounded by this ramp structure 43 is an inner sleeve 47, wherein between the ramp structure 43 and the inner sleeve 47 is provided a guide structure 46 for receiving said helical spring 55.

On the inner side of the inner sleeve 47, pointing in the direction of the coupling member 34 belonging to the main unit, is provided a lead-in structure 48, and on the opposite side a retaining structure 40. The retaining structure 40 comprises respectively six gaps 41 and six stop faces 42, wherein sliding surfaces 45 are respectively provided between the gaps 41 and the stop faces 42.

The joining of the coupling devices 30 consisting of the two coupling members 32, 34 is illustrated with reference to FIG. 6A to 8C.

Figure 6A:
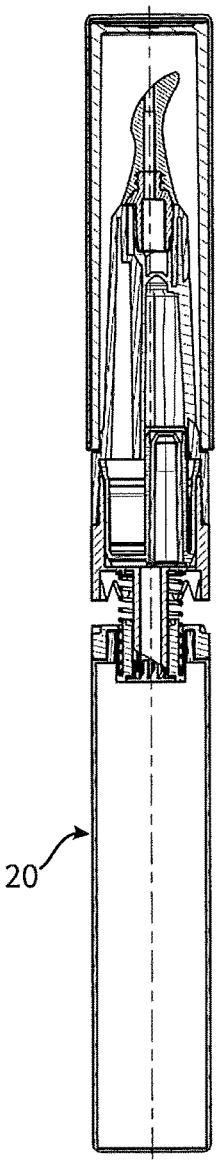
FIGS. 6A to 6C, 7A to 7C and 8A to 8C show the coupling process for coupling the container unit to the main unit.
Figure 6B:
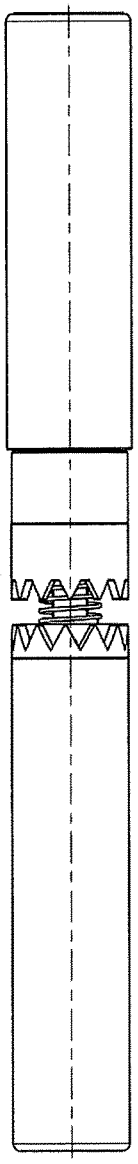
Figure 6C:
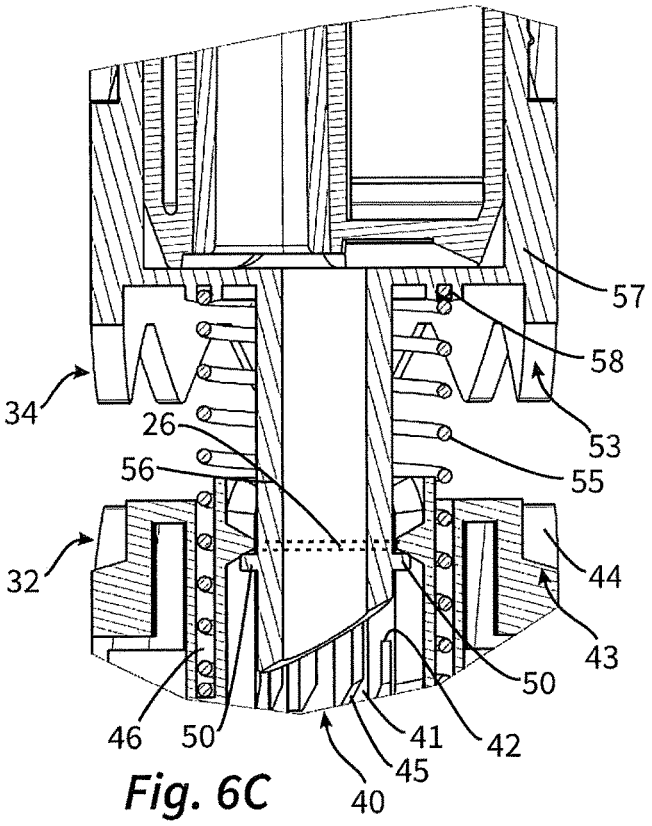
Figure 7A:
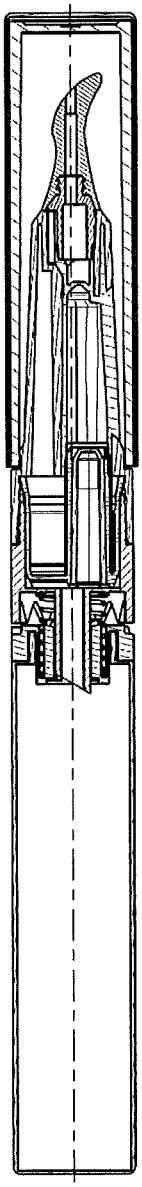
Figure 7B:
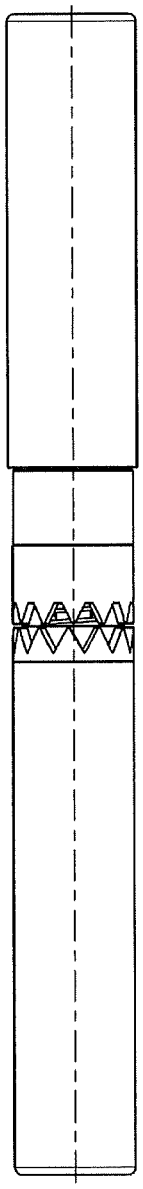
Figure 7C:
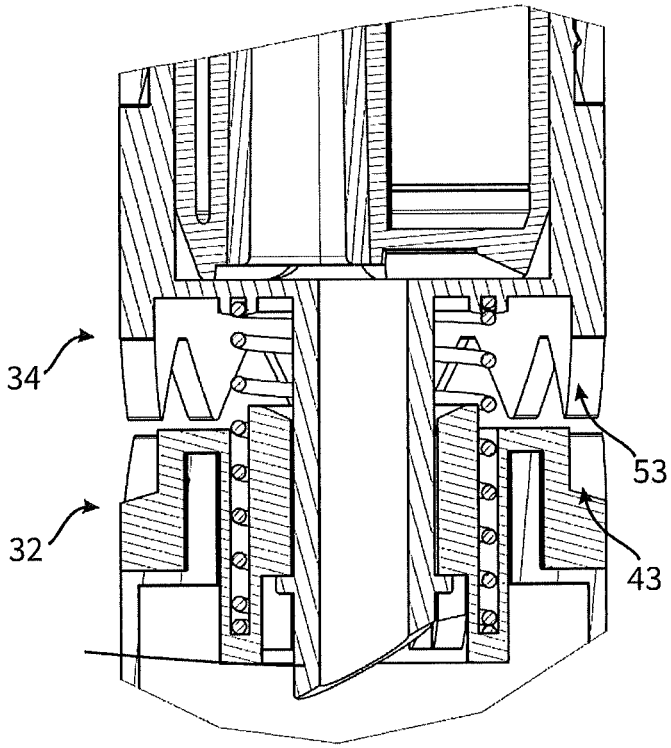
Figure 8A:
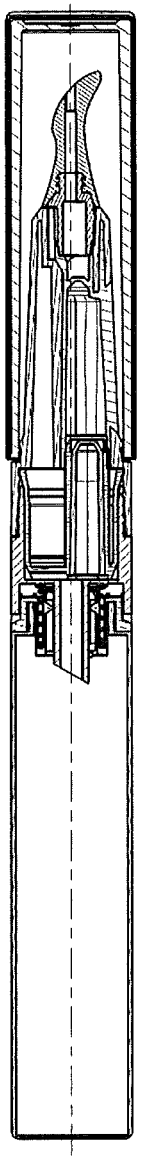
Figure 8B:
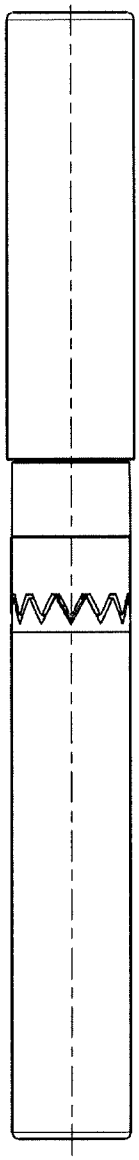
Figure 8C:
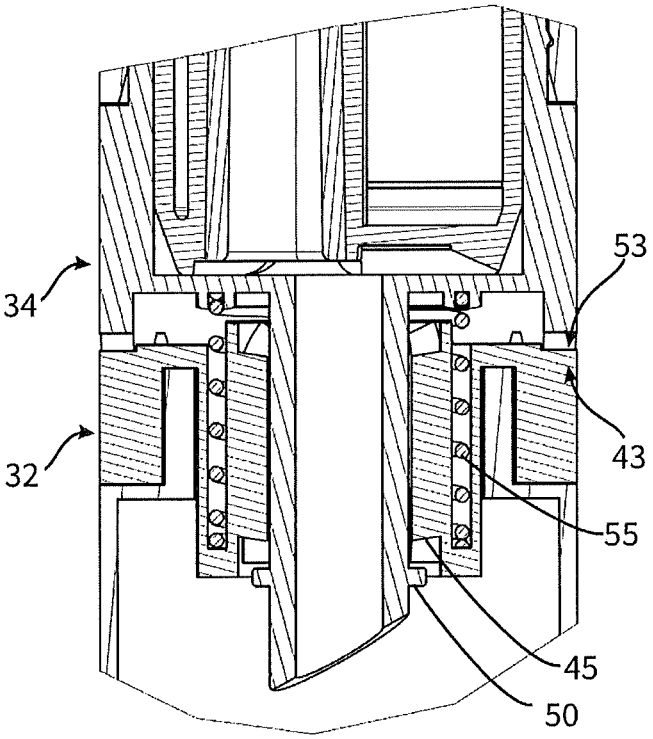

FIG. 6A to 6C show a first phase, in the course of which the container unit 20 is inserted into the receiving shaft 66 in the direction of the arrow 6. As the container unit 20 approaches the coupling member 34 of the main unit 60, the opening sleeve 56 is slid into the outlet opening 22 of the container unit 20 and pierces the membrane 26. At the same time, the helical spring 55 enters the guide structure 46 provided for this purpose, until, in the state of FIG. 6A to 6C, it reaches the bottom thereof, so that a continued movement of the container unit 20 is made in the direction of the coupling member 34 against the force of this helical spring. Shortly after the membrane has been pierced by the opening sleeve 56, the retaining cams 50 enter the sleeve 47 and are brought by the lead-in structure 48 into one of six possible defined rotation settings, wherein, for this purpose, the container unit 20 and the main unit 60 as a whole change to a small extent their relative rotation setting. Upon the continued insertion of the container unit 20, the ramp structures 43, 53, from the setting of FIG. 7A to 7C, enter into engagement with one another. As a result, a further rotation of the main unit 60 and the container unit 20 relative to one another ensues, until the state of FIG. 8A to 8C, in which a desired rotational relative setting between the main unit 60 and the container unit 20 is obtained, is reached. In this desired relative setting, the retaining cams 50 are oriented in alignment with sliding surfaces 45 of the coupling member 32, which sliding surfaces 45 are of the kind which are oriented sloping in the direction of the stop faces 42. The result is that, when the spring device 55 relaxes with the cessation of the force application to the container unit 20, the retaining cams first come into contact with said sliding surfaces, slide down on these and are then pressed against the stop faces 42. A positive locking of the coupling members 32, 34 one to another is now obtained.

The separation which occurs after emptying of the container unit 20 is realized analogously.

Starting from the described state, in which retaining cams 50 bear against the stop faces 42, force is applied to the container unit 20 in the same direction 6 as with the coupling, thus in the direction of the main unit 60. The retaining cams 50 are hereby forced out of the depressions in the stop faces 42 and the ramp structures 43, 53 re-engage. They again give rise to a rotation, so that the retaining cams are again arranged in alignment with the sliding surfaces 45, though now with sliding surfaces 45 which are oriented sloping in the direction of gaps 41. The cessation of the force application at the rear end of the container unit 20 now results in the retaining cams being placed onto those described sliding surfaces 45, sliding down on these, and thus intruding into the channels which form the gaps 41. Since these are continuous in shape, as is shown, for instance, in FIG. 5B, the container unit can now be withdrawn from the receiving shaft 66 of the main unit 60.

The invention claimed is:

1. A liquid dispenser for discharging pharmaceutical or cosmetic liquids, comprising:

a liquid store for receiving liquid prior to a discharge thereof;

a discharge opening for discharging the liquid; and a pumping device having an actuating surface for manual actuation of the pumping device, by which liquid is conveyed from the liquid store to the discharge opening;

wherein the liquid store is provided within an exchangeable container unit couplable to, and uncouplable from, a main unit comprising the pumping device and the discharge opening;

wherein for the exchangeable coupling of the container unit to the main unit a coupling device is provided, the container unit, by pressing against the main unit, is alternately couplable to the main unit and releasable from the main unit via the coupling device; and wherein the coupling device possesses two coupling members, wherein one coupling member is provided on the container unit, and one coupling member is provided on the main unit.

2. The liquid dispenser as claimed in claim 1, wherein the main unit includes a receiving shaft for receiving the container unit, wherein the container unit, in a state connected to the main unit, is set back from a rim which circumferentially surrounds an opening of the receiving shaft or protrudes from the rim by a maximum of 5 mm.

3. The liquid dispenser as claimed in claim 1, wherein:

the two coupling members are matched to one another in such a way that, in a state inserted one into the other, the coupling members are rotatable relative to one another about a rotational axis, and on one coupling member at least one retaining cam is provided, and on the other coupling member a corresponding retaining structure is provided and has stop faces interrupted in a peripheral direction by gaps so that the coupling members, in one relative rotation setting, are releasable from one another in the direction of the rotational axis when the retaining cam is aligned with a gap, and in another relative rotation setting, in which the retaining cam is aligned with a stop face, are positively secured against release in the direction of the rotational axis.

4. The liquid dispenser as claimed in claim 3, wherein:

the container unit includes an outlet opening, the outlet opening in a delivery state of the liquid dispenser being closed off by a membrane, the coupling member of the main unit is provided with an opening sleeve, the opening sleeve, upon the coupling of the container unit to the main unit, puncturing the membrane and thereby opening the container unit, and the retaining cam is provided on an outer side of the opening sleeve.

5. The liquid dispenser as claimed in claim 3, wherein the coupling members include a common clamping device, by which the coupling members, in a relative setting in which the coupling members are spaced further apart compared to a positively secured relative setting, are fixable relative to one another.

6. The liquid dispenser as claimed in claim 3, wherein:

on at least one of the coupling members a ramp structure is provided, and on the other coupling member a mating surface corresponding to the ramp structure is provided, by which the two coupling members are rotated relative to one another about the rotational axis into a defined desired relative rotation setting when the coupling members are pushed axially toward one another, and a number of single ramps of the ramp structure which act in one of the rotational directions tallies with a sum of the stop faces and the gaps provided between the stop faces.

7. The liquid dispenser as claimed in claim 6, wherein:

on the retaining structure, inclined sliding surfaces extending in the peripheral direction are respectively provided between the gaps and the stop faces, and in the desired relative rotation settings, the retaining cam is oriented in such a way relative to the retaining structure such that the retaining cam is aligned with one of the sliding surfaces.

8. The liquid dispenser as claimed in claim 1, wherein a spring device is arranged between the coupling members and in a coupled state of the coupling device applies to the coupling members a mutually opposing force in a separation direction.

9. The liquid dispenser as claimed in claim 8, wherein the spring device comprises a helical spring.

10. The liquid dispenser as claimed in claim 8, wherein the spring device is fixed on one of the coupling members and extends in the direction of the other coupling member.

11. The liquid dispenser as claimed in claim 10, wherein the other coupling member is provided with a guide structure for the spring device, the guide structure being configured to guide the spring device during convergence of the coupling members.

12. The liquid dispenser as claimed in claim 8, wherein the spring device is configured in one piece with one of the coupling members.

13. The liquid dispenser as claimed in claim 1, wherein:

the container unit includes an outlet opening, the outlet opening in a delivery state of the liquid dispenser being closed off by a membrane, and the coupling member of the main unit is provided with an opening sleeve, the opening sleeve, upon the coupling of the container unit to the main unit, puncturing the membrane and thereby opening the container unit.

14. The liquid dispenser as claimed in claim 13, wherein the membrane is configured in one piece with the coupling member of the container unit.

15. The liquid dispenser as claimed in claim 13, wherein the coupling member of the main unit includes an element having both the opening sleeve and a fixing region for a spring device.

16. The liquid dispenser as claimed in claim 1, wherein a housing of the liquid dispenser has a rod shape with a length of at least 100 mm and a maximum diameter of 18 mm.

17. The liquid dispenser as claimed in claim 1, wherein the liquid store is filled with one of the following: a pharmaceutical or cosmetic liquid for topical application; a cosmetic or pharmaceutical skin care product; a make-up liquid; lip gloss; nail varnish; mascara; eyeshadow liquid; make-up remover; or nail varnish remover.

18. The liquid dispenser as claimed in claim 1, wherein the discharge opening is provided on an applicator surface angled in relation to a direction of principal extent of the liquid dispenser.

19. A liquid dispenser set, wherein:

the liquid dispenser set comprises a liquid dispenser as claimed in claim 1, comprising the main unit and the container unit, and the liquid dispenser set comprises at least one further container unit configured for coupling to the main unit.

20. The liquid dispenser as claimed in claim 1, wherein the actuating surface of the liquid dispenser is configured for actuation orthogonally to a direction of principal extent of the liquid dispenser.

21. The liquid dispenser as claimed in claim 1, wherein the liquid dispenser at least in a region of the actuating surface has a maximum diameter of 22 mm.

22. The liquid dispenser as claimed in claim 1, wherein the discharge opening is provided on an applicator including a sponge or a textile application surface.

23. The liquid dispenser as claimed in claim 1, wherein the discharge opening is provided on an applicator with a rotatable application roller or application ball for rolling along a user's skin.

24. The liquid dispenser as claimed in claim 1, wherein the discharge opening is provided on an applicator with a brush.

* * * * *